US006899246B2

(12) United States Patent
Gehring et al.

(10) Patent No.: US 6,899,246 B2
(45) Date of Patent: May 31, 2005

(54) CONTAINMENT VESSEL

(75) Inventors: Debra Gay Gehring, Cincinnati, OH (US); Ty Eric Martin, Loveland, OH (US); John Martin Howell, Maineville, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/308,776

(22) Filed: Dec. 3, 2002

(65) Prior Publication Data

US 2004/0040965 A1 Mar. 4, 2004

Related U.S. Application Data

(60) Provisional application No. 60/406,562, filed on Aug. 28, 2002.

(51) Int. Cl.[7] ..... B65D 41/36
(52) U.S. Cl. ..... 220/293; 220/783; 215/209
(58) Field of Search ..... 220/293, 297, 220/298, 783–790; 215/209, 208–225, 294, 296, 354–361

(56) References Cited

U.S. PATENT DOCUMENTS

| | | | | | |
|---|---|---|---|---|---|
| 1,941,050 | A | | 12/1933 | Punte | |
| 2,079,177 | A | | 5/1937 | Membrino | |
| 2,706,065 | A | * | 4/1955 | Stone | 220/789 |
| 3,023,925 | A | * | 3/1962 | Sher | 220/786 |
| 3,790,015 | A | * | 2/1974 | Imamura | 215/209 |
| 3,850,326 | A | * | 11/1974 | Ryles | 215/224 |
| 3,941,300 | A | | 3/1976 | Troth | |
| 4,279,355 | A | | 7/1981 | Schwartz et al. | |
| 4,789,057 | A | * | 12/1988 | Fisher | 206/1.5 |
| 4,830,206 | A | * | 5/1989 | Fisher | 215/209 |
| 5,638,976 | A | | 6/1997 | Arnold | |
| 5,660,303 | A | * | 8/1997 | Hirose | 220/791 |
| 5,791,473 | A | * | 8/1998 | Decker et al. | 206/407 |
| 6,439,409 | B1 | * | 8/2002 | Dressel et al. | 215/228 |

FOREIGN PATENT DOCUMENTS

| | | |
|---|---|---|
| EP | 1134164 | 9/2001 |

* cited by examiner

*Primary Examiner*—Lien Ngo
(74) *Attorney, Agent, or Firm*—John M. Howell; Eileen L. Hughett; Tara M. Rosnell

(57) ABSTRACT

The present invention is a vessel for containing consumer products. Parts of the containment vessel are made of material sufficiently capable of being deformed by the mechanical force applied by the hands of the consumer while avoiding accidental opening during shipment or display of the vessel on store shelves. The vessel can be made of a suitable material to display the contents of the containment vessel.

10 Claims, 6 Drawing Sheets

CONTAINMENT VESSEL

CROSS REFERENCE TO RELATED APPLICATIONS

This application claims the benefit of U.S. Provisional Application No. 60/406,562, filed Aug. 28, 2002.

FIELD OF INVENTION

This invention pertains to vessels or packages for containing products. These containment vessels artfully display the product while securing the vessel to prevent unintended loss of the product from the containment vessel, but also provide a simple access to the consumer.

BACKGROUND OF THE INVENTION

Containment vessels or packages are well known in the art. Said vessels are often used to hold solid or liquid products. U.S. Pat. No. 1,941,050, to Punte, issued Dec. 26, 1933 and assigned to Continental Can Corporation, discloses friction closed containers having a body with a projection about the container's open end or mouth with a complementary bead about the periphery of the cover where upon slipping the cover the mouth, the bead rides over the body's projection wherein the cover is retained on the container body. U.S. Pat. No. 2,079,177 to Membrino issued May 4, 1937 discloses cylindrical transparent cellulose film or sheet of cellophane that has no sharp folds or creases that could cause the package to rupture. This package comprises a tubular body having base and top cups fitting within the tube, securely fastened by means of a suitable adhesive. U.S. Pat. No. 4,279,355, to Schwartz et al., issued Jul. 21, 1981, discloses containers having an open-topped cylindrical container body having a pair of tabs on the upper end of the outside of the container and a removable cylindrical resilient cap having side wall grooves on the inside matching the tabs in location. When the cap is deformable to accommodate the tabs, the cap cannot be removed from the container body without first rotating the cap to free the wedged tabs then ovaling the cap to allow the cap to be rotated to align the vertical grooves in the cap with the tabs. Such a container prohibits removal of cap by young children. U.S. Pat. No. 5,638,976, to Arnold, issued Jun. 17, 1997, discloses a container with a rotating locking lid. The container carries at least two circumferentially spaced ribs tapered longitudinally in thickness from a relatively narrow rib end to a relatively wide rib end in a given circumferential direction. Such lid containers are employed on garbage can to lock the top on the can without rapidly wearing out.

While disclosing variations of containers that resist spilling their contents, there is a need for a containment vessel having simple means for locking and unlocking the vessel while being readily adaptable for displaying the vessel's contents to retail consumers without opening the vessel.

SUMMARY OF THE INVENTION

The present invention is a containment vessel for consumer products wherein the vessel comprises a vessel body extending vertically from a base having at least one vessel body tab at a point along the periphery of the upper terminus of said vessel body; an base affixed at the end of said vessel body; and an independently-formed end cap at the end opposite said base, fitting upon and about the periphery of the upper terminus of said vessel body; wherein upon assembly, tabs engage complementary grooves to secure the end cap to the containment vessel, deterring the vertical motion of said end cap from the vessel body, wherein access to the containment vessel is achieved when said vessel body is twisted in an axial direction in relation to the end cap until the tabs disengage the grooves wherein said end cap is vertically removable from said vessel body.

The containment vessel is made of material sufficiently capable of being deformed by the mechanical force applied by the hands in order to access its contents without accidental opening during shipment. Once purchased, the containment vessel can be simply opened by the consumer. The containment vessel can be made of a material sufficiently able to display its contents without having to open the vessel to view its contents.

All documents cited are, in relevant part, incorporated herein by reference; the citation of any document is not to be construed as an admission that it is prior art with respect to the present invention.

DETAILED DESCRIPTION OF THE INVENTION

Figure 1:
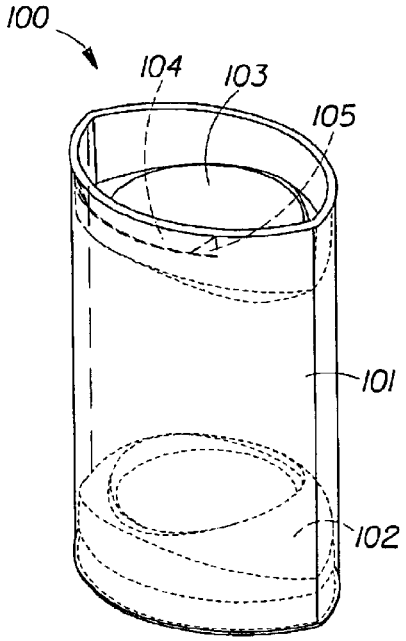
FIG. 1 Perspective view of assembled containment vessel.

Referring now to the drawings, FIG. 1 illustrates the containment vessel (100) of the present invention. The containment vessel comprises a vessel body (101), a base (102), and the end cap (103). When assembled, said containment vessel securely holds a product/products within said containment vessel.

The vessel body of the present invention includes a variety of horizontal cross sectional shapes including round, triangular, rectangular, polygonal and any other shape combining straight and curved edges. FIG. 1 shows a particular embodiment of said vessel body (101) having an oval/eye-shaped horizontal cross-section. The vessel body (101) extends vertically upward from a base (102) extending to a length for accommodating the desired contents of said containment vessel (100).

Figure 3:
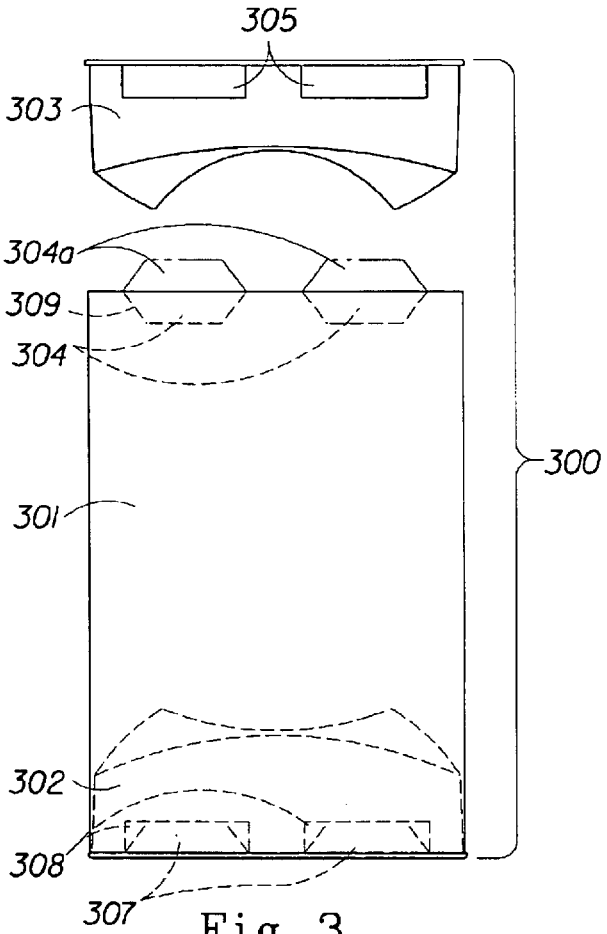
FIG. 3 Exploded view of containment vessel with an integrally-formed base.
Figure 4:
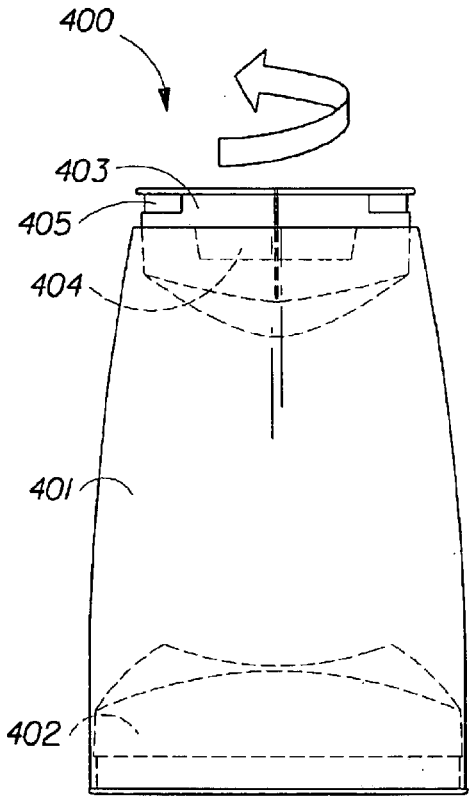
FIG. 4 Planar view of containment vessel in a deformed state.
Figure 4A:
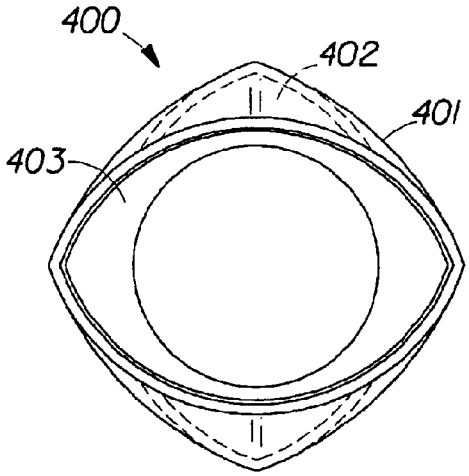
FIG. 4*a* Overhead view of deformed containment vessel.

Said vessel body (101) can be deformable or non-deformable in relationship to the end cap (103). Therefore, the basis of the selection of whether the vessel body is deformable or not is whether said end cap causes the body to deform or whether the end cap deforms when rotated within the vessel body. In FIG. 1 the vessel body (101) is deformable and the end cap (103) is non-deformable. Deformable is defined herein as capable of changing its horizontal cross section shape from its original shape under mechanical force to another shape without destruction of the object upon which the force is applied. For purposes of this definition, the mechanical force is relative easy wringing or twisting motion using one's hands. In FIG. 4, the vessel body has been twisted by hand to a deformed shape wherein upon release or cessation of mechanical force, said vessel body (401) reverts back to its original oval shape as shown in FIG. 3 vessel body (301). In an alternative embodiment of the invention shown in FIG. 6, said vessel body (601) is rigid or non-deformable wherein said end cap (603) of said containment vessel (600) is deformable and changes shape upon being turned or twisted by hand as illustrated by FIG. 6*a*.

Figure 2:
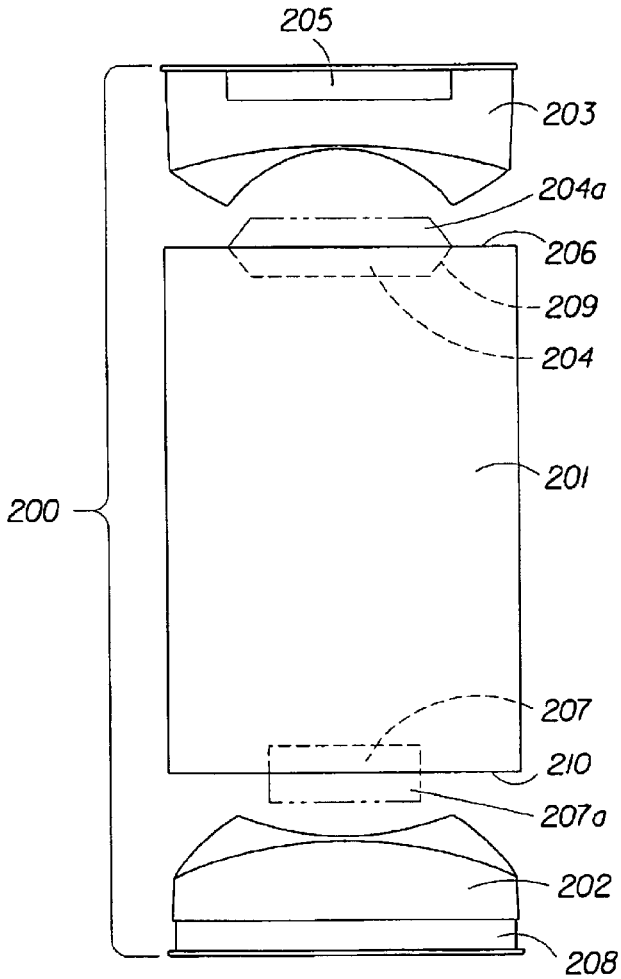
FIG. 2 Exploded view of containment vessel.

Said vessel body (201) of FIG. 2 comprises a tab (204). Said end cap (203) contains a complementary groove (205). Said tab (204) is integrally formed with the sidewalls of said vessel body (201) near the periphery of said upper terminus (206) of said vessel body (201). Alternatively said tab may be fixedly attached to said vessel body (201) utilizing any means for affixing said tabs that are known in the art including, but not necessarily limited to gluing, sonic welding and solvent bonding. In the particular embodiment of FIG. 2 of the invention, said tabs (204) are integrally formed when said vessel body (201) is die cut wherein the tab (204*a*) extends above the edge of said periphery of said upper terminus (206) of said vessel body (201). In this embodiment, said tab (204*a*) is folded inward towards the inside of vessel body (201) along the edge of the periphery of said upper terminus (206) of said vessel body (201) prior to said containment vessel's assembly such that said tab (204) is at an angle of no more than 90° from the interior surface of said vessel body (201) wherein upon assembly, tab (204) locks in complementary groove (205) of said end cap (203).

FIG. 2 illustrates a particular embodiment of the invention wherein tab (204) is the same lateral width (at the point it is folded) as the complementary groove (205). This width specification of the tab, however, is not necessary in all cases. Essentially the maximum width of the tab can be no greater than the width of the complementary groove (205), allowing said tab (204) to snap into said groove (205) on said end cap (203). Said tab (204) is laterally tapered at approximately 135° angle between the edge of the upper terminus of the said vessel body (201). The tapered surfaces (209) of said tab (204) are cut prior to said tab being folded along the planar edge of said upper terminus (206) of said vessel body (201). An alternative embodiment is where said tab (204) is only tapered on one edge, thus allowing opening of the containment vessel in only one direction. As illustrated in FIG. 4, the taper of said tab (404) facilitates its disengagement from said groove (405), permitting removal of end cap (403) upon said end cap (403) being rotated at least about 45°0 in either direction. As shown in FIG. 2, said base (202) has a tab (207) that is absent any tapering, that is said tab (207) has a 90° angle between it and the edge of the lower terminus (210) of the said vessel body (201). In such an embodiment, said tab (207) locks into groove (208) on said base (202) of said vessel body (201) wherein to remove said base (202) from said vessel body (201) a mechanical force must be applied that will deform the tab sufficiently such that said containment vessel (200) is not reusable.

The alternate embodiment in FIG. 3 shows multiple tabs (304) integrally formed on said vessel body (301). Tabs (304) have a taper (309) at about a 135° angle as discussed above, wherein the rotational movement of said deformable portion of the containment vessel, in this embodiment the vessel body (301), must be greater than about 45°. However, depending upon the geometry and design of said end caps and said tabs, and the variety of shapes of containment vessels, the taper of said tabs may be from 1°–180°. The multiple tabs (304) on said vessel body (301) snap into complementary multiple grooves (305) or alternatively a single circumferential, continuous groove about the external lateral surface of the said end cap. In FIG. 3 the base (302) is integrally formed within the vessel body.

In an alternate embodiment, the vessel body has a groove or multiplicity of grooves located along the periphery of the upper terminus of said vessel body. Said groove extends laterally and parallel with base of the said vessel body. An independently formed non-deforming end cap fits within the upper terminus of said vessel body and has at least one tab. Said tab of the end cap should be at an angle of no greater than about 90° from the planar surface of said end cap in order to engage the groove in said vessel body.

Figure 7:
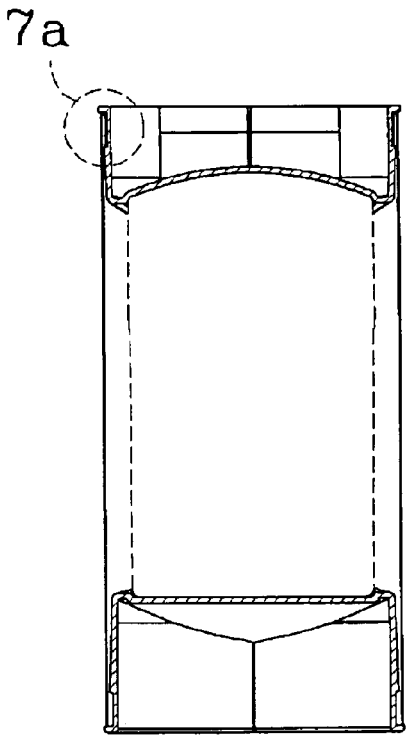
FIG. 7 Vertical cross section view of tab and groove assembly.
Figure 7A:
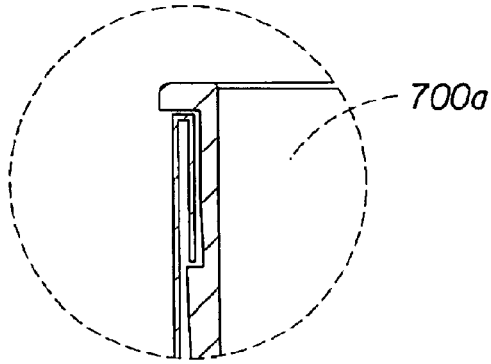
FIG. 7*a* Vertical cross section view of tab and groove assembly with tab affixed to the vessel body.
Figure 7B:
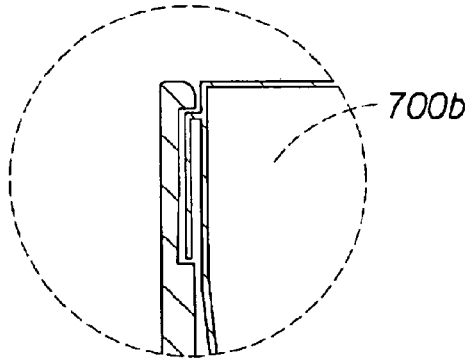
FIG. 7*b* Vertical cross section view of tab and groove assembly with tab affixed to the end cap.
Figure 7C:
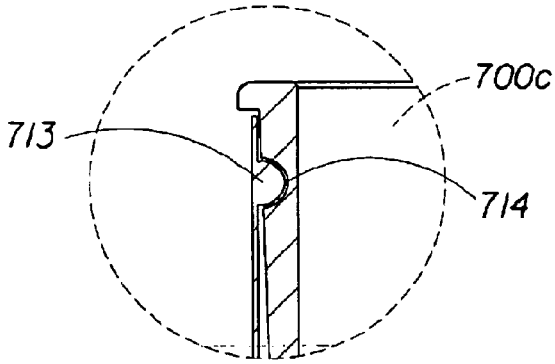
FIG. 7*c* Vertical cross section view of bead and indent assembly with bead affixed to the end cap.

It should be understood that in place of the tab and groove illustrated in FIG. 7*a* and FIG. 7*b*, one skilled in the art could envision alternatives including a raised bead in place of the tab as shown in FIG. 7*c*. The bead (713*c*) could be located on either the vessel body or the end cap, wherein the opposing part would have a complementary indentation (714*c*). Said bead (713*c*) could be inserted into said indent (714*c*) by downward force on the end cap (703) wherein said bead snaps into said indent as shown in said FIG. 7*c*. Said bead would have a taper at its linear end point that horizontally fit within said indent. Upon the mechanical twisting force being applied, said bead rides out of said indent, allowing said end cap's removal from said vessel body.

The end cap of the containment vessel of the present invention is independently formed from said vessel body and may be snap fitted to said vessel body to secure the assembled containment vessel. The end cap may be either deformable or non-deformable, but is the opposite of the vessel body. While either embodiment satisfactorily works, the choice of the material for the end cap is generally made in terms of manufacturing efficiencies and costs.

Figure 6:
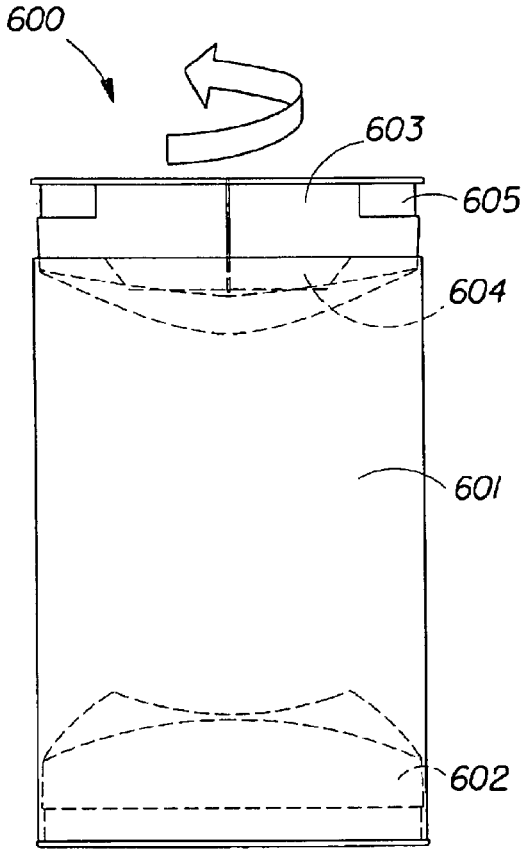
FIG. 6 Planar view of assembled containment vessel in a deformed state.
Figure 6A:
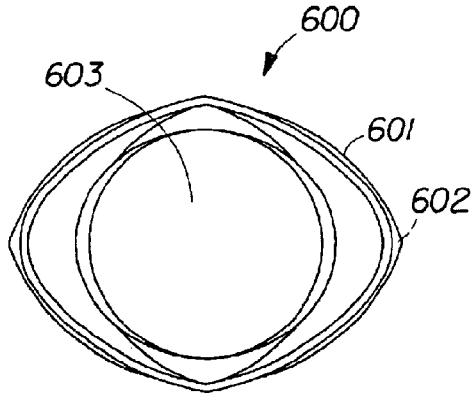
FIG. 6*a* Overhead view of the deformed containment vessel.
Figure 8A:
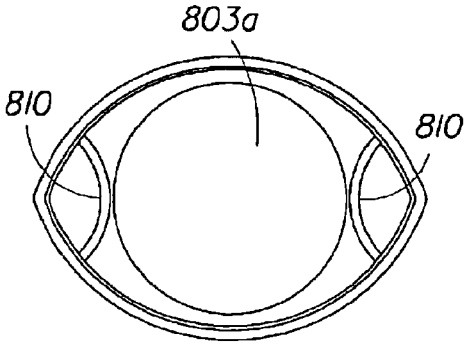
FIG. 8*a* Overhead view of end cap with integrally formed grip.
Figure 8B:
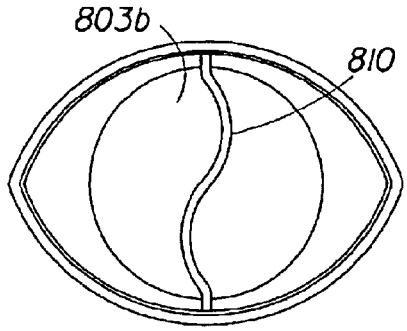
FIG. 8*b* Overhead view of end cap with integrally formed grip.

FIG. 6 shows an embodiment wherein said end cap (603) is deformable wherein the vessel body (601) is non-deformable. In the particular embodiment shown therein, said end cap (603) must be rotated at least approximately 45° relative to said vessel body (601) to allow for easy removal of said end cap (603) from said vessel body (601). As said end cap (603) is rotated to the predetermined minimum angle for its removal, the tab (604) on end cap (603) disengages said groove (605) on vessel body (601). In particular embodiments of the present invention, illustrated in FIGS. 8*a* and 8*b*, a gripping surface is integrally formed on said end cap (803), this raised surface (810) allows for gripping said turning the end cap.

Figure 9:
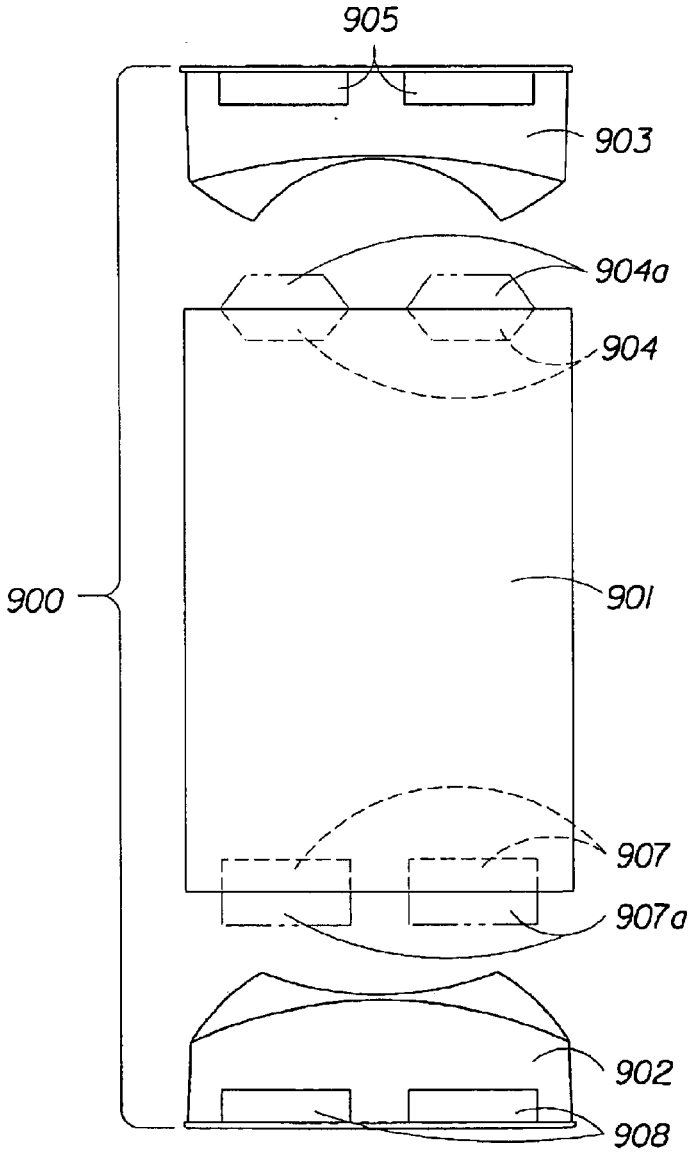
FIG. 9 Exploded view of containment vessel.

The base may also be integrally formed with said vessel body or may be assembled to said vessel body using the tab and groove feature as disclosed above. In a particular embodiment shown in FIG. 9, the base is designed to lock onto the body to prevent relatively easy access of the contents of the containment vessel. This is achieved using tab (907) that has a 90° angle as discussed above. In an alternative embodiment shown in FIG. 9, there are multiple lower tabs (907) fixedly attached at the edge of the periphery of the lower terminus (910) of said vessel body (901), that engage a complementary groove (908) located on said base (902). Said grooves (908) are separate as opposed to the entire circumference of said base as illustrated in FIG. 2 groove (208). Regardless of the embodiment chosen, rotation of said base with respect to said vessel body does not disengage said lower tabs from said grooves or groove.

Figure 5:
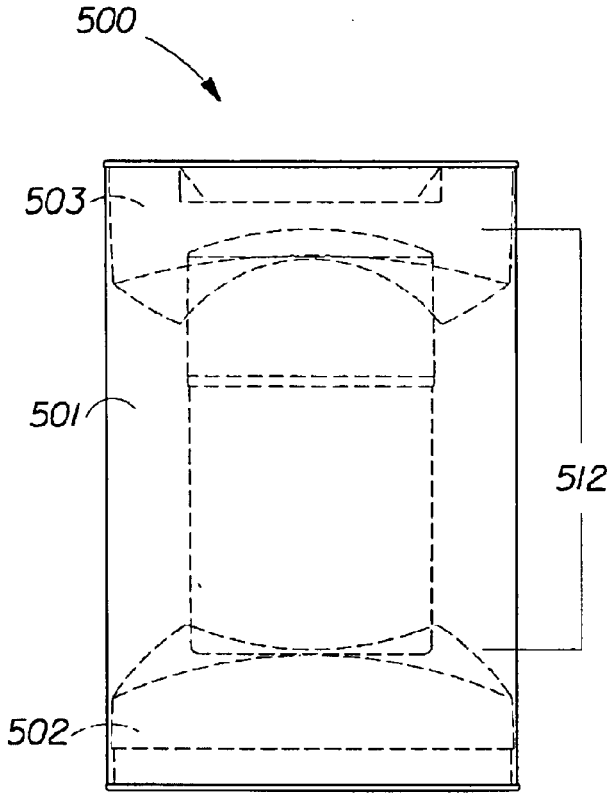
FIG. 5 Planar view of assembled containment vessel with application package inside.

An alternative embodiment is shown in FIG. 5 wherein said base (502) and said end cap (503) each contain complementary and integrally formed containment recesses for holding/locating said applicator package or product. By complementary, it is meant that each containment recess projects toward each other and towards the center of the interior of said containment vessel (500). These containment recesses have a profile or shape to engage the top and bottom of an applicator package (512), holding said package snuggly within said recesses and the center of said containment vessel. The length of said vessel body (501) and the distance between said recesses is dependent on the length of said applicator package (512).

Containment Vessel Fabrication Materials and Methods

The material used for the manufacture of the present invention includes non-deformable and deformable materials. Non-deformable material choices for said invention include, but are not limited to, thermoplastic materials such as polypropylene (PP), polyethylene (PE), polystyrene (PS), polyethylene-terepthalate (PET), and blends thereof. Preferable deformable materials include materials that flex, allowing easy rotation of the part made of said deformable material wherein upon deformation, there is little if any destructive damage such as cracking, tearing, or permanent deformation to said part. Materials which meet these criterion include, but are not limited to, polypropylene (PP), polyethylene (PE), polystyrene (PS), polyethylene-terepthalate (PET), polyvinyl chloride (PVC), paperboard, and blends or laminations thereof.

Whether making deformable or non-deformable parts, the parts of the containment vessel may be manufactured by any number of plastic and paper manufacturing methods known in the art including but not limited to injection molding.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A containment vessel for limiting access to the contents of said vessel wherein said vessel comprises:

a) a deformable vessel body extending vertically having a plurality of vessel body grooves at a point along the periphery of the upper terminus of said vessel body;

b) a base affixed at the end of said vessel body opposite said vessel body grooves; and c) an independently-formed, relatively non-deformable end cap at the end opposite said base, fitting upon and about the periphery of the upper termius of said vessel body, having a plurality of raised beads projection about the periphery of said end cap;

wherein upon assembly, said beads engage said grooves, deterring the vertical motion of said end cap from said vessel body, wherein access said containment vessel is achieved when said end cap is twisted in an axial direction in relation to said vessel body until said beads disengage said grooves wherein said end cap is vertically removable from said vessel body.

2. The containment vessel of claim 1 wherein the grooves in said vessel body is of sufficient length to require radial rotation of said end cap within and about said vessel body of at least about 30 degrees from its initial locked position to disengage said beads from said grooves, thereby allowing vertical removal of said end cap from said vessel body.

3. The containment vessel of claim 1 has a plurality of complementary raised beads located about periphery of said end cap wherein said end cap raised beads engage the complimentary vessel body grooves to limit access to contents of said containment vessel.

4. The containment vessel according to claim 3 wherein said end cap raised beads are tapered at their opposite lateral ends to facilitate removal of said raised beads from said complimentary body vessel grooves.

5. A containment vessel for limiting access to the contents of said vessel wherein said vessel comprises:

a) a deformable vessel body extending vertically having a plurality of vessel body grooves at a point near the periphery of the upper terminus of said vessel body;

b) a base affixed at the end of said vessel body opposite said vessel body grooves; and c) an independently-formed, relatively non-deforming end cap at the end opposite said base, fitting upon and about the periphery of the upper terminus of said vessel body, having a plurality of end cap tabs, each tab having a leading end of said tab projecting in a direction enabling engagement of said tab and said groove;

wherein upon assembly said tabs engage said vessel body groove, deterring the vertical motion of said end cap from said vessel body, wherein access to said containment vessel is achieved when said vessel body is twisted in an axial direction in relation to said end cap until said tabs disengage said grooves wherein said end cap is vertically removable from said vessel body.

6. The containment vessel of claim 5 wherein said end cap comprises a non-deformable material sufficiently stiff to deform said vessel body as said end cap is rotated within and about the periphery of said vessel body in order to deform said vessel body sufficiently to disengage said tabs from said grooves wherein said end cap is vertically removable from said vessel body.

7. The containment vessel of claim 5 wherein said end cap is made of a material selected from the group consisting of PET, PVC, PET, PE, PP, PS, paper, and mixtures thereof.

8. The containment vessel according to claim 5 wherein upon said tabs being orientated to engage said grooves, the leading end of said tabs first engages said grooves is at an angle no greater than 90° from the interior surface of said vessel body interior.

9. The containment vessel of claim 5 wherein said end cap comprises an integrally-formed containment recess for upright support of an applicator package or product within the interior of said containment vessel.

10. The containment vessel of claim 5 wherein said base of said containment vessel body comprises an integrally formed containment recess for an applicator package or product within said containment vessel.

* * * * *

UNITED STATES PATENT AND TRADEMARK OFFICE

CERTIFICATE OF CORRECTION

PATENT NO. : 6,899,246 B2
APPLICATION NO. : 10/308776
DATED : May 31, 2005
INVENTOR(S) : Gehring et al.

It is certified that error appears in the above-identified patent and that said Letters Patent is hereby corrected as shown below:

In Col. 5:

line 62, “termius” should read --terminus--.

line 63, “projection” should read --projecting--.

line 65, “said grooves” should read --said body grooves--.

In Col. 6:

line 36, “groove” should read --grooves--.

Signed and Sealed this

Thirteenth Day of November, 2007

JON W. DUDAS
*Director of the United States Patent and Trademark Office*